US009529292B2

(12) United States Patent
Tanaka et al.

(10) Patent No.: US 9,529,292 B2
(45) Date of Patent: Dec. 27, 2016

(54) ELECTROSTATIC CHARGE IMAGE DEVELOPING TONER, ELECTROSTATIC CHARGE IMAGE DEVELOPER, AND TONER CARTRIDGE

(71) Applicant: FUJI XEROX CO., LTD., Tokyo (JP)

(72) Inventors: Tomoaki Tanaka, Kanagawa (JP); Kotaro Yoshihara, Kanagawa (JP); Eisuke Iwazaki, Kanagawa (JP); Narumasa Sato, Kanagawa (JP); Asafumi Fujita, Kanagawa (JP); Noriyuki Mizutani, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/617,316

(22) Filed: Feb. 9, 2015

(65) Prior Publication Data

US 2016/0085166 A1 Mar. 24, 2016

(30) Foreign Application Priority Data

Sep. 19, 2014 (JP) ..... 2014-191949

(51) Int. Cl.
*G03G 9/087* (2006.01)
*G03G 9/08* (2006.01)

(52) U.S. Cl.
CPC ..... *G03G 9/08733* (2013.01); *G03G 9/08* (2013.01); *G03G 9/0819* (2013.01)

(58) Field of Classification Search
CPC ..... G03G 9/08711; G03G 9/08755; G03G 9/08782
See application file for complete search history.

(56) References Cited

U.S. PATENT DOCUMENTS

| | | | | |
|---|---|---|---|---|
| 9,110,392 | B2 | 8/2015 | Fukuri | |
| 9,280,076 | B1 | 3/2016 | Li et al. | |
| 9,304,423 | B2 | 4/2016 | Iwazaki et al. | |
| 2007/0166635 | A1 | 7/2007 | Yamamoto et al. | |
| 2008/0096119 | A1 | 4/2008 | Yamamoto et al. | |
| 2008/0124635 | A1 | 5/2008 | Nakamura et al. | |
| 2008/0138733 | A1 | 6/2008 | Ueda et al. | |
| 2008/0160442 | A1* | 7/2008 | Kim | G03G 9/08782 430/109.3 |
| 2008/0166156 | A1* | 7/2008 | Kawase | G03G 9/0808 399/222 |
| 2009/0098475 | A1* | 4/2009 | Yamada | G03G 9/09328 430/108.4 |
| 2009/0297225 | A1* | 12/2009 | Yamada | G03G 9/0819 399/252 |
| 2012/0040285 | A1 | 2/2012 | Shibata et al. | |
| 2012/0219321 | A1 | 8/2012 | Fukao et al. | |
| 2014/0127620 | A1 | 5/2014 | Bayley et al. | |
| 2014/0134532 | A1 | 5/2014 | Sumioka | |
| 2015/0118610 | A1 | 4/2015 | Nosella et al. | |
| 2015/0118613 | A1 | 4/2015 | Nosella et al. | |
| 2016/0085168 | A1 | 3/2016 | Iwazaki et al. | |

FOREIGN PATENT DOCUMENTS

| | | | |
|---|---|---|---|
| JP | 2004-109485 | A | 4/2004 |
| JP | 2007-192952 | A | 8/2007 |
| JP | 2008-145568 | A | 6/2008 |
| JP | 2011-123483 | A | 6/2011 |
| JP | 2012-255957 | A | 12/2012 |
| JP | 2013-130824 | A | 7/2013 |
| JP | 2013-142877 | A | 7/2013 |
| JP | 2013-254123 | A | 12/2013 |

OTHER PUBLICATIONS

U.S. Appl. No. 14/807,525, filed Jul. 23, 2015 in the name of Yoshida et al.
U.S. Appl. No. 14/624,711, filed Feb. 18, 2015 in the name of Yoshihara et al.
Apr. 13, 2016 Office Action issued in U.S. Appl. No. 14/624,711.

* cited by examiner

*Primary Examiner* — Hoa V Le
(74) *Attorney, Agent, or Firm* — Oliff PLC

(57) ABSTRACT

An electrostatic charge image developing toner includes a toner particle including a binder resin containing a polyester resin, a release agent containing hydrocarbon wax, and a styrene (meth)acrylic resin, wherein 70% or more of the release agent of the entire release agent is present in a portion within 800 nm from the surface of the toner particle, and wherein the styrene (meth)acrylic resin forms a domain having an average diameter of smaller than 0.3 μm in the toner particle.

19 Claims, 2 Drawing Sheets

ELECTROSTATIC CHARGE IMAGE DEVELOPING TONER, ELECTROSTATIC CHARGE IMAGE DEVELOPER, AND TONER CARTRIDGE

CROSS-REFERENCE TO RELATED APPLICATIONS

This application is based on and claims priority under 35 USC 119 from Japanese Patent Application No. 2014-191949 filed Sep. 19, 2014.

BACKGROUND

1. Technical Field

The present invention relates to an electrostatic charge image developing toner, an electrostatic charge image developer, and a toner cartridge.

2. Related Art

A method of visualizing image information through an electrostatic charge image, such as electrophotography, is currently used in various fields. In electrophotography, the image information is formed on a surface of an image holding member (photoreceptor) as an electrostatic charge image through charging and exposure processes, a toner image is developed on the surface of the photoreceptor using a developer containing a toner, and this toner image is visualized as an image through a transfer process of transferring the toner image to a recording medium such as a sheet and a fixing process of fixing the toner image onto a surface of the recording medium.

SUMMARY

According to an aspect of the invention, there is provided an electrostatic charge image developing toner including:

a toner particle including a binder resin containing a polyester resin, a release agent containing hydrocarbon wax, and a styrene (meth)acrylic resin, wherein 70% or more of the release agent of the entire release agent is present in a portion within 800 nm from the surface of the toner particle, and wherein the styrene (meth)acrylic resin forms a domain having an average diameter of smaller than 0.3 μm in the toner particle.

BRIEF DESCRIPTION OF THE DRAWINGS

Exemplary embodiments of the present invention will be described in detail based on the following figures, wherein.

DETAILED DESCRIPTION

Figure 1:
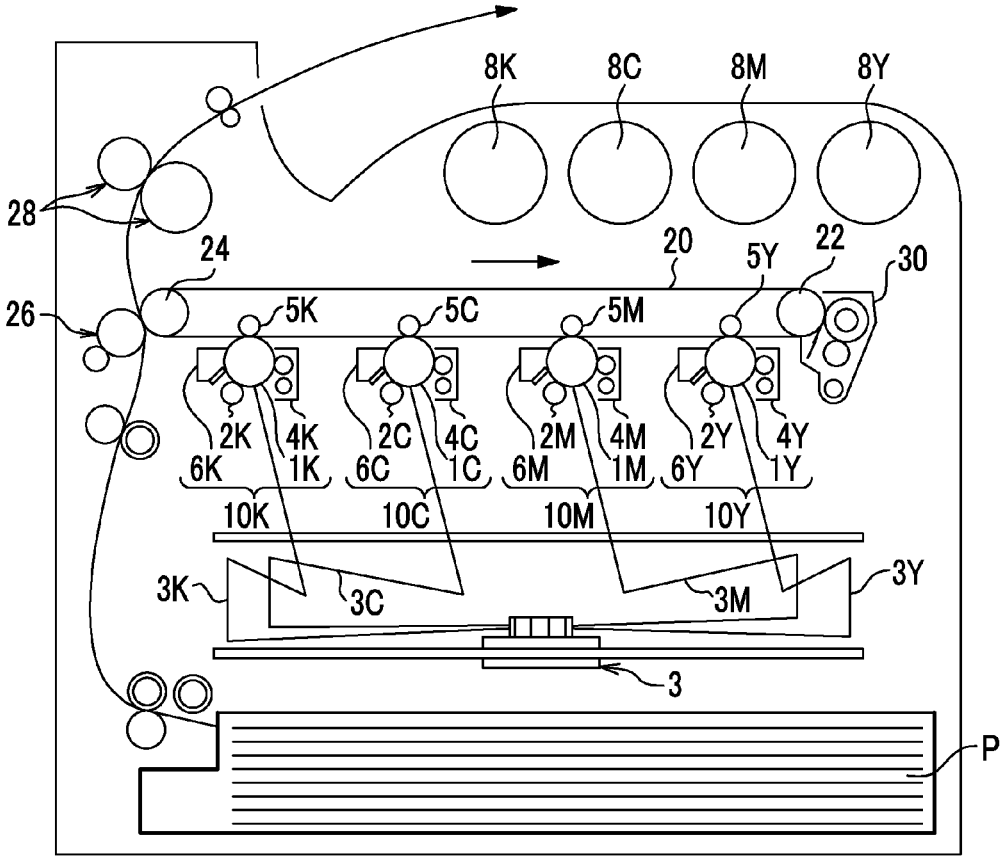
FIG. 1 is a schematic configuration diagram showing an example of an image forming apparatus according to the exemplary embodiment.

Hereinafter, exemplary embodiments which are examples of the invention will be described in detail.

Electrostatic Charge Image Developing Toner

An electrostatic charge image developing toner according to the exemplary embodiment (hereinafter, referred to as a "toner") includes a toner particle containing a binder resin containing a polyester resin, a release agent containing hydrocarbon wax, and a styrene (meth)acrylic resin.

In the toner particle, 70% or more of the release agent of the entire release agent is present in a portion within 800 nm from the surface of the toner particle, and the styrene (meth)acrylic resin forms a domain having an average diameter of smaller than 0.3 μm in the toner particle.

The expression that the styrene (meth)acrylic resin forms a domain in the toner particle means a state where a sea-island structure in which the binder resin is set as a sea portion and the styrene (meth)acrylic resin is set as an island portion is formed. That is, the domain of the styrene (meth) acrylic resin is the island portion of the sea-island structure.

According to the configuration described above, the toner according to the exemplary embodiment prevents generation of cracks on the toner particle due to a mechanical load. The reason therefor is not clear, but the following are assumed.

First, in the toner particle containing the polyester resin, the styrene (meth)acrylic resin, and the hydrocarbon wax, the polyester resin is set as a matrix (sea portion), and the styrene (meth)acrylic resin and the hydrocarbon wax form the domain (island portion). This is because compatibility between the polyester resin and the styrene (meth)acrylic resin, and the hydrocarbon wax is low.

When a mechanical load due to a stirring member of a developing unit is applied to the toner particle having this sea-island structure, strain may occur on a boundary of the domain of the styrene (meth)acrylic resin and the polyester resin (hereinafter, also referred to as a "domain boundary of the styrene (meth)acrylic resin") due to stress. In addition, cracks may be generated on the toner particle from the domain boundary of the styrene (meth)acrylic resin due to this strain. Particularly, since the compatibility between the styrene (meth)acrylic resin and the hydrocarbon wax is high, when the hydrocarbon wax is present in the center of the toner particle, the domain of the styrene (meth)acrylic resin is easily biased around the boundary of the domain of the hydrocarbon wax, and the cracks are more easily generated on the toner particle.

Since the hydrocarbon wax is soft, it is considered that the strain hardly occurs in the boundary between the domain of the hydrocarbon wax and the polyester resin, even when the stress is generated in the toner particle.

With respect to this, when a diameter of the domain of the styrene (meth)acrylic resin is decreased so as to have an average diameter of smaller than 0.3 μm, the stress in the boundary of the domain of the styrene (meth)acrylic resin is dispersed even when the stress is generated in the toner particle. Therefore, the strain occurring in the domain boundary is reduced.

Meanwhile, when 70% or more of the release agent of the entire release agent containing the hydrocarbon wax is controlled to be present in a surface layer portion which is a portion within 800 nm from the surface of the toner particle, the domain of the styrene (meth)acrylic resin is hardly biased to the center of the toner particle. In addition, even when the toner particle receives the mechanical load, the impact thereof is absorbed by the surface layer portion of the toner particle, and the generation of stress in the inside of the toner particle is prevented. As a result, the strain generated in the domain boundary of the styrene (meth) acrylic resin is reduced.

As described above, it is assumed that the toner according to the exemplary embodiment prevents the generation of cracks on the toner particle due to the mechanical load.

Herein, in the toner according to the exemplary embodiment, 70% or more of the release agent of the entire release agent is present in a portion within 800 nm from the surface of the toner particle. Hereinafter, a presence ratio of the release agent which is present in a portion within 800 nm from the surface of the toner particle is referred to as a "presence ratio of the release agent".

The presence ratio of the release agent is equal to or greater than 70% and is preferably equal to or greater than 80%, in order to prevent cracks of the toner particle. The upper limit of the presence ratio of the release agent is preferably 100%.

Meanwhile, an average diameter of the domains of the styrene (meth)acrylic resins is smaller than 0.3 μm. The average diameter thereof is preferably equal to or smaller than 0.26 μm and more preferably equal to or smaller than 0.22 μm, in order to prevent cracks on the toner particle. However, the average diameter thereof is preferably equal to or greater than 0.15 μm, in order to prevent minute cracks.

Regarding the domains of the styrene (meth)acrylic resin, the number ratio of the domains having a diameter in a range of the average diameter ±0.1 μm is preferably equal to or greater than 65%, more preferably equal to or greater than 70%, and even more preferably equal to or greater than 75%. When the number ratio of the domains having a diameter in a range of the average diameter ±0.1 μm is in the range described above, the particle diameter distribution of the domains of the styrene (meth)acrylic resin is narrowed, and the domain boundary is more uniformly stressed. Accordingly, the strain is hardly generated locally on the domain boundary, and it is easier to prevent generation of cracks on the toner particle.

Regarding the domains of the styrene (meth)acrylic resin, the number ratio of the domains having a diameter in a range of the average diameter ±0.2 μm is preferably equal to or greater than 80%, more preferably equal to or greater than 85%, and even more preferably equal to or greater than 90%. When the number ratio of the domains having a diameter in a range of the average diameter ±0.2 μm is in the range described above, the presence ratio of the domains having an extremely large or small diameter with respect to the average diameter is decreased. Accordingly, the stress in the domain boundary is approximately uniform. Therefore, the strain is hardly generated locally on the domain boundary, and it is easier to prevent generation of cracks on the toner particle.

In particular, the domain having an extremely large diameter clearly becomes a reason for the cracks on the toner particle due to continuous small impacts. The domain having an extremely small diameter makes the toner particle hard, and also brittle, and thus clearly becomes a reason for the small cracks on the toner particle. Accordingly, when the presence ratio of the domains having a diameter in a range of the average diameter ±0.2 μm is in the range described above, it is easy to prevent cracks on the toner particle due to the continuous small impacts and generation of small cracks on the toner particle.

Hereinafter, measurement methods of presence ratio of the release agent and the average diameter of the domains of the styrene (meth)acrylic resin will be described.

A sample and an image for measurement are prepared by the following method.

The toner is mixed with and buried in an epoxy resin and the epoxy resin is solidified. The obtained solidified material is cut with an ultramicrotome device (Ultracut UCT manufactured by Leica), and a thin-sliced sample having a thickness of 80 nm to 130 nm is prepared. Next, the obtained thin-sliced sample is dyed with ruthenium tetroxide in a desiccator at 30° C. for 3 hours. Then, an SEM image of the dyed thin-sliced sample is obtained using an ultrahigh-resolution field-emission scanning electron microscope (FE-SEM, S-4800 manufactured by Hitachi High-Technologies Corporation). Herein, since the release agent, the styrene (meth)acrylic resin, and the polyester resin are easily dyed with ruthenium tetroxide in this order, each component is identified by shading caused by a degree of dyeing. In a case where the shading is difficult to be determined due to the state of the sample, the dyeing time may be adjusted.

In the cross section of the toner particle, since the domain of the colorant is smaller than the domain of the release agent and the domain of the styrene (meth)acrylic resin, they may be differentiated according to the size.

The presence ratio of the release agent is a value measured by the following method.

In the SEM image, the cross section of the toner particle having a maximum length which is 85% or more of a volume average particle diameter of the toner particle is selected, the domain of the dyed release agent is observed, the area of the release agent of the entire toner particles and the area of the release agent present in an area within 800 nm from the surface of the toner particles are determined, and a ratio of both areas (area of the release agent present in an area within 800 nm from the surface of the toner particles/area of the release agent of the entire toner particles) is calculated. This calculation is performed for 100 toner particles, and an average value thereof is set as the presence ratio of the release agent.

The reason for selecting the cross section of the toner particle having a maximum length which is 85% or more of a volume average particle diameter of the toner particle is as follows. Since the toner is a three-dimensional shape and the SEM image is a cross section, the end portion may be cut and the cross section of the end portion does not reflect the domain of the release agent of the toner.

The average diameter of the domain of the styrene (meth) acrylic resin is a value measured by the following method.

In the SEM image, 30 cross sections of the toner particle having a maximum length which is 85% or more of a volume average particle diameter of the toner particle are selected, and total 100 domains of the dyed styrene (meth) acrylic resins are observed. The maximum length of each domain is measured, the maximum length is assumed as a diameter of the domain, and the arithmetic average is set as the average diameter.

In addition, with the measured diameters of total 100 domains, the number ratio of the domains having a diameter in a range of the average diameter ±0.1 μm, and the number ratio of the domains having a diameter in a range of the average diameter ±0.2 μm are determined.

As a method of controlling the presence ratio of the release agent to be equal to or greater than 70%, a method of setting the toner particle with a core/shell structure and using the release agent when forming a shell is used, for example.

The average diameter of the domain of the styrene (meth) acrylic resin and the distribution of the domain size are controlled by a method of preparing the toner particle by aggregation and coalescence and adjusting a volume average particle diameter of resin particles contained in a styrene (meth)acrylic resin particle dispersion used at the time of the preparing; a method of preparing plural styrene (meth) acrylic resin particle dispersions having different volume average particle diameters and using the combination thereof; or the like, for example.

Hereinafter, the toner according to the exemplary embodiment will be described in detail.

The toner according to the exemplary embodiment includes the toner particles. The toner may include an external additive which is externally added to the toner particle.

Toner Particle

The toner particle includes a binder resin, a release agent containing hydrocarbon wax, and a styrene (meth)acrylic resin. The toner particle may contain other internal additives such as a colorant.

The toner particle, for example, includes a sea-island structure in which the release agent and the styrene (meth) acrylic resin are dispersed in the binder resin.

Binder Resin

As the binder resin, a polyester resin is used in a viewpoint of fixability. A rate of the polyester resin with respect to the entire binder resin is equal to or greater than 85% by weight, preferably equal to or greater than 95% by weight, and more preferably 100% by weight, for example.

As the polyester resin, a well-known polyester resin is used, for example.

Examples of the polyester resin include polycondensates of polyvalent carboxylic acids and polyols. A commercially available product or a synthediameterd product may be used as the polyester resin.

Examples of the polyvalent carboxylic acid include aliphatic dicarboxylic acids (e.g., oxalic acid, malonic acid, maleic acid, fumaric acid, citraconic acid, itaconic acid, glutaconic acid, succinic acid, alkenyl succinic acids, adipic acid, and sebacic acid), alicyclic dicarboxylic acids (e.g., cyclohexanedicarboxylic acid), aromatic dicarboxylic acids (e.g., terephthalic acid, isophthalic acid, phthalic acid, and naphthalenedicarboxylic acid), anhydrides thereof, or lower alkyl esters (having, for example, from 1 to 5 carbon atoms) thereof. Among these, for example, aromatic dicarboxylic acids are preferably used as the polyvalent carboxylic acid.

As the polyvalent carboxylic acid, a tri- or higher-valent carboxylic acid employing a crosslinked structure or a branched structure may be used in combination with a dicarboxylic acid. Examples of the tri- or higher-valent carboxylic acid include trimellitic acid, pyromellitic acid, anhydrides thereof, or lower alkyl esters (having, for example, from 1 to 5 carbon atoms) thereof.

The polyvalent carboxylic acids may be used alone or in combination of two or more kinds thereof.

Examples of the polyol include aliphatic diols (e.g., ethylene glycol, diethylene glycol, triethylene glycol, propylene glycol, butanediol, hexanediol, and neopentyl glycol), alicyclic diols (e.g., cyclohexanediol, cyclohexanedimethanol, and hydrogenated bisphenol A), and aromatic diols (e.g., ethylene oxide adducts of bisphenol A and propylene oxide adducts of bisphenol A). Among these, for example, aromatic diols and alicyclic diols are preferably used, and aromatic diols are more preferably used as the polyol.

As the polyol, a tri- or higher-valent alcohol employing a crosslinked structure or a branched structure may be used in combination with a diol. Examples of the tri- or higher-valent polyol include glycerin, trimethylolpropane, and pentaerythritol.

The polyols may be used alone or in combination of two or more kinds thereof.

The glass transition temperature (Tg) of the polyester resin is preferably from 50° C. to 80° C., and more preferably from 50° C. to 65° C.

The glass transition temperature is determined by a DSC curve obtained by differential scanning calorimetry (DSC). More specifically, the glass transition temperature is determined by "extrapolating glass transition starting temperature" disclosed in a method of determining the glass transition temperature of JIS K7121-1987 "Testing Methods for Transition Temperatures of Plastics".

A weight average molecular weight (Mw) of the polyester resin is preferably from 5,000 to 1,000,000, and more preferably from 7,000 to 500,000.

A number average molecular weight (Mn) of the polyester resin is preferably from 2,000 to 100,000.

A molecular weight distribution Mw/Mn of the polyester resin is preferably from 1.5 to 100, and more preferably from 2 to 60.

The weight average molecular weight and the number average molecular weight of the resin are measured by gel permeation chromatography (GPC). The molecular weight measurement by GPC is performed with tetrahydrofuran as a solvent, using a HLC-8120 manufactured by Tosoh Corporation as a measurement device and a TSKgel Super HM-M (15 cm) manufactured by Tosoh Corporation as a column. The weight average molecular weight and the number average molecular weight are calculated from results of this measurement using a calibration curve of molecular weights created with monodisperse polystyrene standard samples.

The polyester resin is obtained with a well-known preparing method. Specific examples thereof include a method of conducting a reaction at a polymerization temperature set to 180° C. to 230° C., if necessary, under reduced pressure in the reaction system, while removing water or alcohol generated during condensation.

When monomers of the raw materials do not dissolve or become compatibilized at a reaction temperature, a high-boiling-point solvent may be added as a solubilizing agent to dissolve the monomers. In this case, a polycondensation reaction is conducted while distilling away the solubilizing agent. When a monomer having poor compatibility is present in a copolymerization reaction, the monomer having poor compatibility and an acid or an alcohol to be polycondensed with the monomer may be previously condensed and then polycondensed with a major component.

The content of the binder resin is, for example, preferably from 40% by weight to 95% by weight, more preferably from 50% by weight to 90% by weight, and even more preferably from 60% by weight to 85% by weight, with respect to the entire toner particles.

As the binder resin, other binder resin may be used with the polyester resin.

Examples of the other binder resin include a vinyl resin formed of a homopolymer including monomers such as styrenes (for example, styrene, p-chlorostyrene, α-methyl styrene, or the like), (meth)acrylic esters (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, 2-ethylhexyl methacrylate, or the like), ethylenic unsaturated nitriles (for example, acrylonitrile, methacrylonitrile, or the like), vinyl ethers (for example, vinyl methyl ether, vinyl isobutyl ether, or the like), vinyl ketones (for example, vinyl methyl ketone, vinyl ethyl ketone, vinyl isopropenyl ketone, or the like), olefins (for example, ethylene, propylene, butadiene, or the like), or a copolymer obtained by combining two or more kinds of these monomers (herein, excluding the styrene (meth)acrylic resin).

Examples of the other binder resin include a non-vinyl resin such as an epoxy resin, a polyester resin, a polyurethane resin, a polyamide resin, a cellulose resin, a polyether resin, and a modified rosin, a mixture of these and a vinyl resin, or a graft polymer obtained by polymerizing a vinyl monomer in the presence thereof.

These other binder resins may be used alone or in combination with two or more kinds thereof.

Styrene (Meth)Acrylic Resin

The styrene (meth)acrylic resin is a copolymer obtained by at least copolymerizing a monomer having a styrene structure and a monomer having a (meth)acrylic acid structure. "(Meth)acrylic" is an expression including both of "acrylic acid" and "methacrylic acid".

Examples of the monomer having a styrene structure (hereinafter, referred to as a "styrene monomer") include styrene, alkyl substituted styrene (for example, α-methyl styrene, 2-methyl styrene, 3-methyl styrene, 4-methyl styrene, 2-ethyl styrene, 3-ethyl styrene, or 4-ethyl styrene), halogen substituted styrene (for example, 2-chlorostyrene, 3-chlorostyrene, or 4-chlorostyrene), and vinyl naphthalene. The styrene monomer may be used alone or in combination of two or more kinds thereof.

Among these, styrene is preferable as the styrene monomer, in viewpoints of ease of reaction, ease of controlling of the reaction, and availability.

Examples of the monomer having a (meth)acrylic acid structure (hereinafter, referred to as a "(meth)acrylic monomer") include (meth)acrylic acid and (meth)acrylic acid ester. Examples of (meth)acrylic acid ester include (meth) acrylic acid alkyl ester (for example, n-methyl (meth)acrylate, n-ethyl (meth)acrylate, n-propyl (meth)acrylate, n-butyl (meth)acrylate, n-pentyl (meth)acrylate, n-hexyl (meth) acrylate, n-heptyl (meth)acrylate, n-octyl (meth)acrylate, n-decyl (meth)acrylate, n-dodecyl (meth)acrylate, n-lauryl (meth)acrylate, n-tetradecyl (meth)acrylate, n-hexadecyl (meth)acrylate, n-octadecyl (meth)acrylate, isopropyl (meth)acrylate, isobutyl (meth)acrylate, t-butyl (meth)acrylate, isopentyl (meth)acrylate, amyl (meth)acrylate, neopentyl (meth)acrylate, isohexyl (meth)acrylate, isoheptyl (meth) acrylate, isooctyl (meth)acrylate, 2-ethylhexyl (meth) acrylate, cyclohexyl (meth)acrylate, or t-butylcyclohexyl (meth)acrylate), (meth)acrylic acid aryl ester (for example, phenyl (meth)acrylate, biphenyl (meth)acrylate, diphenylethyl (meth)acrylate, t-butylphenyl (meth)acrylate, or terphenyl (meth)acrylate), dimethylaminoethyl (meth)acrylate, diethylaminoethyl (meth)acrylate, methoxyethyl (meth) acrylate, 2-hydroxyethyl (meth)acrylate, β-carboxyethyl (meth)acrylate, and (meth)acrylamide. The (meth))acrylic acid monomer may be used alone or in combination of two or more kinds thereof.

A copolymerization ratio of the styrene monomer and the (meth)acrylic monomer (styrene monomer/(meth)acrylic monomer based on weight) is, preferably from 85/15 to 70/30, for example.

The styrene (meth)acrylic resin preferably has a crosslinked structure, in order to prevent cracks on the toner particle. As the styrene (meth)acrylic resin having a crosslinked structure, a crosslinked material obtained by copolymerizing and crosslinking at least the monomer having a styrene structure, the monomer having a (meth)acrylic acid structure, and a crosslinking monomer, for example.

Examples of the crosslinking monomer include a bi- or higher functional crosslinking agent.

Examples of the bifunctional crosslinking agent include divinyl benzene, divinyl naphthalene, a di(meth)acrylate compound (for example, diethylene glycol di(meth)acrylate, methylenebis (meth)acrylamide, decanediol diacrylate, or glycidyl (meth)acrylate), polyester type di(meth)acrylate, and 2-([1'-methylpropylidene amino]carboxyamino) ethyl methacrylate.

Examples of multifunctional crosslinking agent include a tri(meth)acrylate compound (for example, pentaerythritol tri(meth)acrylate, trimethylolethane tri(meth)acrylate, or trimethylolpropane tri(meth)acrylate), a tetra(meth)acrylate compound (for example, tetramethylolmethane tetra (meth) acrylate, or oligoester (meth)acrylate), 2,2-bis(4-methacryloxy, polyethoxy phenyl) propane, diallyl phthalate, triallyl cyanurate, triallyl asocyanurate, triallyl isocyanurate, triallyl trimellitate, and diaryl chlorendate.

A copolymerization ratio of the crosslinking monomer with respect to the entirety of monomers (crosslinking monomer/entirety of monomer based on weight) is, preferably from 2/1000 to 30/1000, for example.

A number average molecular weight Mn of the styrene (meth)acrylic resin is, for example, from 10,000 to 50,000, preferably from 15,000 to 40,000, and more preferably from 20,000 to 30,000, in order to prevent cracks on the toner particle.

A weight average molecular weight Mw of the styrene (meth)acrylic resin is, for example, from 30,000 to 200,000, preferably from 40,000 to 100,000, and more preferably from 50,000 to 80,000, in order to prevent cracks on the toner particle.

The number average molecular weight Mn and the weight average molecular weight Mw of the styrene (meth)acrylic resin particles are values measured by the same method as that used for measuring the molecular weight of the polyester resin.

The content of the styrene (meth)acrylic resin is, for example, from 10% by weight to 30% by weight, more preferably from 12% by weight to 28% by weight, and even more preferably from 15% by weight to 25% by weight with respect to the toner particle, in order to achieve fluidity and a storage property of the toner and to prevent cracks on the toner particle.

Release Agent

As the release agent, hydrocarbon wax is used. A rate of the hydrocarbon wax with respect to the entire release agent is at least equal to or greater than 85% by weight, preferably equal to or greater than 95% by weight, and more preferably 100% by weight.

The hydrocarbon wax is wax having hydrocarbon as a structure, and examples thereof include Fischer-Tropsch wax, polyethylene wax (wax having a polyethylene structure), polypropylene wax (wax having a polypropylene structure) paraffin wax (wax having a paraffin structure), and microcrystalline wax. Among these, Fischer-Tropsch wax is preferable as the hydrocarbon wax, in order to prevent cracks on the toner particle.

A melting temperature of the hydrocarbon wax is, for example, from 85° C. to 110° C. and preferably from 90° C. to 105° C., in order to prevent cracks on the toner particle.

The melting temperature of the hydrocarbon wax is obtained from "melting peak temperature" described in the method of obtaining a melting temperature in JIS K7121-1987 "Testing Methods for Transition Temperatures of Plastics", from a DSC curve obtained by differential scanning calorimetry (DSC).

The content of the hydrocarbon wax is, for example, preferably from 1% by weight to 20% by weight and more preferably from 5% by weight to 15% by weight, with respect to the entirety of the toner particles.

Colorant

Examples of the colorant include various pigments such as carbon black, chrome yellow, Hansa yellow, benzidine yellow, threne yellow, quinoline yellow, pigment yellow, permanent orange GTR, pyrazolone orange, vulcan orange, watchung red, permanent red, brilliant carmine 3B, brilliant carmine 6B, DuPont oil red, pyrazolone red, lithol red, Rhodamine B Lake, Lake Red C, pigment red, rose bengal, aniline blue, ultramarine blue, calco oil blue, methylene blue chloride, phthalocyanine blue, pigment blue, phthalocyanine green, and malachite green oxalate, and various dyes such as acridine dyes, xanthene dyes, azo dyes, benzoquinone dyes, azine dyes, anthraquinone dyes, thioindigo dyes, dioxadine dyes, thiazine dyes, azomethine dyes, indigo dyes, phthalocyanine dyes, aniline black dyes, polymethine dyes, triphenylmethane dyes, diphenylmethane dyes, and thiazole dyes.

The colorants may be used alone or in combination of two or more kinds thereof.

If necessary, the colorant may be surface-treated or used in combination with a dispersing agent. Plural kinds of colorants may be used in combination thereof.

The content of the colorant is, for example, preferably from 1% by weight to 30% by weight, and more preferably from 3% by weight to 15% by weight with respect to the entirety of the toner particles.

Other Additives

Examples of other additives include known additives such as a magnetic material, a charge-controlling agent, and an inorganic powder. The toner particles contain these additives as internal additives.

Characteristics of Toner Particle

The toner particle may be a toner particle having a single-layer structure and may be a toner particle having a so-called core/shell structure composed of a core (core particle) and a coating layer (shell layer) coated on the core, and the toner particle having a core/shell structure is preferable.

Herein, the toner particle having a core/shell structure is, for example, preferably configured with a core including a binder resin and, if necessary, other additives such as a colorant, and a coating layer including a binder resin and a release agent.

The volume average particle diameter (D50v) of the toner particles is preferably from 2 μm to 10 μm, and more preferably from 4 μm to 8 μm.

Various average particle diameters and various particle size distribution indices of the toner particles are measured using a Coulter Multisizer II (manufactured by Beckman Coulter, Inc.) and ISOTON-II (manufactured by Beckman Coulter, Inc.) as an electrolyte.

In the measurement, from 0.5 mg to 50 mg of a measurement sample is added to 2 ml of a 5% aqueous solution of surfactant (preferably sodium alkylbenzene sulfonate) as a dispersing agent. The obtained material is added to 100 ml to 150 ml of the electrolyte.

The electrolyte in which the sample is suspended is subjected to a dispersion treatment using an ultrasonic disperser for 1 minute, and a particle size distribution of particles having a particle diameter of 2 μm to 60 μm is measured by a Coulter Multisizer II using an aperture having an aperture diameter of 100 μm. 50,000 particles are sampled.

Cumulative distributions by volume and by number are drawn from the side of the smallest diameter with respect to particle size ranges (channels) separated based on the measured particle size distribution. The particle diameter when the cumulative percentage becomes 16% is defined as that corresponding to a volume average particle diameter D16v and a number average particle diameter D16p, while the particle diameter when the cumulative percentage becomes 50% is defined as that corresponding to a volume average particle diameter D50v and a number average particle diameter D50p. Furthermore, the particle diameter when the cumulative percentage becomes 84% is defined as that corresponding to a volume average particle diameter D84v and a number average particle diameter D84p.

Using these, a volume average particle size distribution index (GSDv) is calculated as $(D84v/D16v)^{1/2}$, while a number average particle size distribution index (GSDp) is calculated as $(D84p/D16p)^{1/2}$.

The shape factor SF1 of the toner particles is preferably from 110 to 150, and more preferably from 120 to 140.

The shape factor SF1 is obtained through the following expression.

$$SF1=(ML^2/A)\times(\pi/4)\times 100 \quad \text{Expression:}$$

In the foregoing expression, ML represents an absolute maximum length of a toner particle, and A represents a projected area of a toner particle.

Specifically, the shape factor SF1 is numerically converted mainly by analyzing a microscopic image or a scanning electron microscopic (SEM) image by the use of an image analyzer, and is calculated as follows. That is, an optical microscopic image of particles scattered on a surface of a glass slide is input to an image analyzer Luzex through a video camera to obtain maximum lengths and projected areas of 100 particles, values of SF1 are calculated through the foregoing expression, and an average value thereof is obtained.

External Additives

Examples of the external additive include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, and $MgSO_4$.

Surfaces of the inorganic particles as an external additive are preferably subjected to a hydrophobizing treatment. The hydrophobizing treatment is performed by, for example, dipping the inorganic particles in a hydrophobizing agent. The hydrophobizing agent is not particularly limited and examples thereof include a silane coupling agent, silicone oil, a titanate coupling agent, and an aluminum coupling agent. These may be used alone or in combination of two or more kinds thereof.

Generally, the amount of the hydrophobizing agent is, for example, from 1 part by weight to 10 parts by weight with respect to 100 parts by weight of the inorganic particles.

Examples of the external additive also include resin particles (resin particles such as polystyrene, PMMA, and melamine resin) and a cleaning activator (e.g., metal salt of a higher fatty acid represented by zinc stearate, and fluorine polymer particles).

The amount of the external additives externally added is, for example, preferably from 0.01% by weight to 5% by weight, and more preferably from 0.01% by weight to 2.0% by weight with respect to the toner particles.

Preparing Method of Toner

The toner particles are prepared and the toner particles may be set as the toner according to the exemplary embodiment, and the external additive is externally added to the toner particle and this may be set as the toner.

The toner particles may be prepared using any of a dry method (e.g., kneading and pulverizing method) and a wet method (e.g., aggregation and coalescence method, suspension and polymerization method, and dissolution and suspension method). The preparing method is not particularly limited to these preparing methods, and a known preparing method is employed. Among these, the toner particles are preferably obtained by an aggregation and coalescence method.

Specifically, for example, when the toner particles are prepared by an aggregation and coalescence method, the toner particles are prepared through: a process of preparing a polyester resin particle dispersion in which polyester resin particles are dispersed (polyester resin particle dispersion preparation process); a process of preparing styrene (meth) acrylic resin particle dispersion in which styrene (meth) acrylic resin particles are dispersed (styrene (meth)acrylic resin particle dispersion preparation process); a process of preparing a release agent dispersion in which release agent particles are dispersed (release agent dispersion preparation process); a process of aggregating resin particles (and other particles, if necessary) in a mixed dispersion obtained by mixing the two resin particle dispersions with each other (in dispersion obtained by mixing the other particle dispersion such as a colorant, too, if necessary) and forming first aggregated particles (first aggregated particle forming process); a process of mixing the first aggregated particle dispersion in which the first aggregated particles are dispersed, the polyester resin particle dispersion, and the release agent dispersion, aggregating the polyester resin particles and the release agent particles so as to adhere the particles to the surface of the first aggregated particles and forming the second aggregated particles (second aggregated particle forming process); and a process of heating the second aggregated particle dispersion in which the second aggregated particles are dispersed, to coalesce the second aggregated particles, and forming toner particles (coalescence process).

Hereinafter, the respective processes of the aggregation and coalescence method will be described in detail. In the following description, a method of obtaining the toner particles containing the colorant will be described, but the colorant is only used, if necessary. Additives other than the colorant may be used.

Resin Particle Dispersion Preparation Process

First, with the resin particle dispersion in which the polyester resin particles to be the binder resin are dispersed, a styrene (meth)acrylic resin particle dispersion in which the styrene (meth)acrylic resin particles are dispersed, a colorant dispersion in which the colorant particles are dispersed, and a release agent dispersion in which release agent particles are dispersed are prepared.

The polyester resin particle dispersion is prepared by, for example, dispersing the polyester resin particles by a surfactant in a dispersion medium.

Examples of the dispersion medium used for the polyester resin particle dispersion include aqueous mediums.

Examples of the aqueous mediums include water such as distilled water and ion exchange water, and alcohol. These may be used alone or in combination of two or more kinds thereof.

Examples of the surfactant include anionic surfactants such as sulfate ester salt, sulfonate, phosphate, and soap anionic surfactants; cationic surfactants such as amine salt and quaternary ammonium salt cationic surfactants; and nonionic surfactants such as polyethylene glycol, alkylphenol ethylene oxide adduct, and polyol nonionic surfactants. Among these, anionic surfactants and cationic surfactants are particularly used. Nonionic surfactants may be used in combination with anionic surfactants or cationic surfactants.

The surfactants may be used alone or in combination of two or more kinds thereof.

As a method of dispersing the polyester resin particles in the dispersion medium, a common dispersing method using, for example, a rotary shearing-type homogenizer, or a ball mill, a sand mill, or a Dyno Mill having media is exemplified. In addition, the polyester resin particles may be dispersed in the dispersion medium using, for example, a phase inversion emulsification method. The phase inversion emulsification method includes: dissolving a resin to be dispersed in a hydrophobic organic solvent in which the resin is soluble; performing neutralization by adding a base to an organic continuous phase (O phase); and performing phase inversion from W/O to O/W by adding water (W phase), thereby dispersing the resin as particles in the aqueous medium.

The volume average particle diameter of polyester resin particles dispersed in the polyester resin particle dispersion is, for example, preferably from 0.01 μm to 1 μm, more preferably from 0.08 μm to 0.8 μm, and even more preferably from 0.1 μm to 0.6 μm.

Regarding the volume average particle diameter of the polyester resin particles, a cumulative distribution by volume is drawn from the side of the smallest diameter with respect to particle size ranges (channels) separated using the particle size distribution obtained by the measurement with a laser diffraction-type particle size distribution measuring device (for example, LA-700 manufactured by Horiba, Ltd.), and a particle diameter when the cumulative percentage becomes 50% with respect to the entirety of the particles is measured as a volume average particle diameter D50v. The volume average particle diameter of the particles in other dispersion is also measured in the same manner.

The content of the polyester resin particles contained in the polyester resin particle dispersion is, for example, preferably from 5% by weight to 50% by weight, and more preferably from 10% by weight to 40% by weight.

The styrene (meth)acrylic resin particle dispersion, the colorant dispersion, and the release agent dispersion are also prepared in the same manner as in the case of the polyester resin particle dispersion. That is, the polyester resin particle dispersion is the same as the styrene (meth)acrylic resin particle dispersion, the colorant dispersion, and the release agent dispersion, in terms of the dispersion medium, the dispersing method, the volume average particle diameter of the particles, and the content of the particles.

First Aggregated Particle Forming Process

Next, the polyester resin particle dispersion, the styrene (meth)acrylic resin particle dispersion, and the colorant dispersion are mixed with each other.

The polyester resin particles, the styrene (meth)acrylic resin particles, and the colorant particles heterogeneously aggregate in the mixed dispersion, thereby forming first aggregated particles having a diameter near a target toner particle diameter and including the polyester resin particles, the styrene (meth)acrylic resin particles, and the colorant particles.

The release agent dispersion may also be mixed if necessary, and the first aggregated particles may include the release agent particles.

Specifically, for example, an aggregating agent is added to the mixed dispersion and a pH of the mixed dispersion is adjusted to acidity (for example, the pH being from 2 to 5). If necessary, a dispersion stabilizer is added. Then, the mixed dispersion is heated at a temperature near the glass transition temperature of the polyester resin particles (specifically, for example, from a temperature 30° C. lower than the glass transition temperature of the polyester resin particles to a temperature 10° C. lower than the glass transition temperature) to aggregate the particles dispersed in the mixed dispersion, thereby forming the first aggregated particles.

In the first aggregated particle forming process, for example, the aggregating agent may be added at room temperature (for example, 25° C.) under stirring of the mixed dispersion using a rotary shearing-type homogenizer, the pH of the mixed dispersion may be adjusted to acidity (for example, the pH being from 2 to 5), a dispersion stabilizer may be added if necessary, and the heating may then be performed.

As the aggregating agent, a surfactant having an opposite polarity to the polarity of the surfactant included in the mixed dispersion, for example, inorganic metal salts and di- or higher-valent metal complexes are used. When a metal complex is used as the aggregating agent, the amount of the aggregating agent used is reduced and charging characteristics are improved.

With the aggregating agent, an additive may be used to form a complex or a similar bond with the metal ions of the aggregating agent. A chelating agent is preferably used as the additive.

Examples of the inorganic metal salts include metal salts such as calcium chloride, calcium nitrate, barium chloride, magnesium chloride, zinc chloride, aluminum chloride, and aluminum sulfate; and inorganic metal salt polymers such as polyaluminum chloride, polyaluminum hydroxide, and calcium polysulfide.

A water-soluble chelating agent may be used as the chelating agent. Examples of the chelating agent include oxycarboxylic acids such as tartaric acid, citric acid, and gluconic acid; aminocarboxylic acid such as iminodiacetic acid (IDA), nitrilotriacetic acid (NTA), and ethylenediaminetetraacetic acid (EDTA).

The amount of the chelating agent added is, for example, preferably from 0.01 parts by weight to 5.0 parts by weight, and more preferably from 0.1 parts by weight to less than 3.0 parts by weight with respect to 100 parts by weight of the resin particles.

Second Aggregated Particle Forming Process

After obtaining the first aggregated particle dispersion in which the first aggregated particles are dispersed, the first aggregated particle dispersion, the polyester resin particle dispersion, and the release agent dispersion are mixed with each other. The polyester resin particle dispersion and the release agent dispersion may be mixed with each other in advance, and this mixed solution may be mixed with the first aggregated particle dispersion.

In the mixed dispersion in which the first aggregated particles, the polyester resin particles, and the release agent particles are dispersed, the particles are aggregated so as to adhere the polyester resin particles and the release agent particles to the surface of the first aggregated particles, and the second aggregated particles are formed.

Specifically, for example, in the first aggregated particle forming process, when the desired particle diameter of the first aggregated particles is achieved, the dispersion in which the polyester resin particles and the release agent particles are dispersed is mixed with the first aggregated particle dispersion. Then, this mixed dispersion is heated at a temperature equal to or lower than the glass transition temperature of the polyester resin. By setting the pH of the mixed dispersion in a range of 6.5 to 8.5, for example, the progress of the aggregation is stopped.

Accordingly, the second aggregated particles are obtained by aggregating the polyester resin particles and the release agent particles so as to adhere the surface of the first aggregated particles.

Coalescence Process

Next, the second aggregated particle dispersion in which the second aggregated particles are dispersed is heated at, for example, a temperature that is equal to or higher than the glass transition temperature of the polyester resin (for example, a temperature that is higher than the glass transition temperature of the polyester resin by 10° C. to 30° C.) to coalesce the second aggregated particles and form toner particles.

By performing the above processes, the toner particles are obtained.

After the coalescence process ends, the toner particles formed in the solution are subjected to a washing process, a solid-liquid separation process, and a drying process, that are well known, and thus dried toner particles are obtained.

In the washing process, preferably, displacement washing using ion exchange water is sufficiently performed from the viewpoint of charging properties. In addition, the solid-liquid separation process is not particularly limited, but suction filtration, pressure filtration, or the like is preferably performed from the viewpoint of productivity. The method for the drying process is also not particularly limited, but freeze drying, flash jet drying, fluidized drying, vibration-type fluidized drying, or the like is preferably performed from the viewpoint of productivity.

The toner according to the exemplary embodiment is prepared by, for example, adding and mixing an external additive to and with dried toner particles. The mixing is preferably performed with, for example, a V-blender, a Henschel mixer, a Lödige mixer, or the like. Furthermore, if necessary, coarse toner particles may be removed using a vibration sieving machine, a wind classifier, or the like.

Electrostatic Charge Image Developer

An electrostatic charge image developer according to the exemplary embodiment includes at least the toner according to the exemplary embodiment.

The electrostatic charge image developer according to the exemplary embodiment may be a single-component developer including only the toner according to the exemplary embodiment, or a two-component developer obtained by mixing the toner with a carrier.

The carrier is not particularly limited, and known carriers are exemplified. Examples of the carrier include a coated carrier in which surfaces of cores formed of a magnetic particle are coated with a coating resin; a magnetic particle dispersion-type carrier in which a magnetic particle is dispersed in and blended into a matrix resin; and a resin impregnation-type carrier in which a porous magnetic particle is impregnated with a resin.

The magnetic particle dispersion-type carrier and the resin impregnation-type carrier may be carriers in which constituent particles of the carrier are cores and have a surface coated with a coating resin.

Examples of the magnetic particle include magnetic metals such as iron, nickel, and cobalt, and magnetic oxides such as ferrite and magnetite.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid copolymer, a straight silicone resin configured to include an organosiloxane bond or a modified product thereof, a fluororesin, polyester, polycarbonate, a phenol resin, and an epoxy resin.

The coating resin and the matrix resin may contain other additives such as a conductive particle.

Examples of the conductive particles include particles of metals such as gold, silver, and copper, carbon black particles, titanium oxide particles, zinc oxide particles, tin oxide particles, barium sulfate particles, aluminum borate particles, and potassium titanate particles.

Herein, a coating method using a coating layer forming solution in which a coating resin and, if necessary, various additives are dissolved in an appropriate solvent is used to coat the surface of a core with the coating resin. The solvent is not particularly limited, and may be selected in consideration of the type of coating resin to be used, coating suitability, and the like.

Specific examples of the resin coating method include a dipping method of dipping cores in a coating layer forming solution; a spraying method of spraying a coating layer forming solution onto surfaces of cores; a fluid bed method of spraying a coating layer forming solution in a state in which cores are allowed to float by flowing air; and a kneader-coater method in which cores of a carrier and a coating layer forming solution are mixed with each other in a kneader-coater and the solvent is removed.

The mixing ratio (weight ratio) between the toner and the carrier in the two-component developer is preferably from 1:100 to 30:100, and more preferably from 3:100 to 20:100 (toner:carrier).

Image Forming Apparatus/Image Forming Method

An image forming apparatus and an image forming method according to the exemplary embodiment will be described.

The image forming apparatus according to the exemplary embodiment is provided with an image holding member, a charging unit that charges a surface of the image holding member, an electrostatic charge image forming unit that forms an electrostatic charge image on a charged surface of the image holding member, a developing unit that accommodates an electrostatic charge image developer and develops the electrostatic charge image formed on the surface of the image holding member with the electrostatic charge image developer to forma toner image, a transfer unit that transfers the toner image formed on the surface of the image holding member onto a surface of a recording medium, and a fixing unit that fixes the toner image transferred onto the surface of the recording medium. As the electrostatic charge image developer, the electrostatic charge image developer according to the exemplary embodiment is applied.

In the image forming apparatus according to the exemplary embodiment, an image forming method (image forming method according to the exemplary embodiment) including a charging process of charging a surface of an image holding member, an electrostatic charge image forming process of forming an electrostatic charge image on the charged surface of the image holding member, a developing process of developing the electrostatic charge image formed on the surface of the image holding member with the electrostatic charge image developer according to the exemplary embodiment to form a toner image, a transfer process of transferring the toner image formed on the surface of the image holding member onto a surface of a recording medium, and a fixing process of fixing the toner image transferred onto the surface of the recording medium is performed.

As the image forming apparatus according to the exemplary embodiment, a known image forming apparatus is applied, such as a direct transfer-type apparatus that directly transfers a toner image formed on a surface of an image holding member onto a recording medium; an intermediate transfer-type apparatus that primarily transfers a toner image formed on a surface of an image holding member onto a surface of an intermediate transfer member, and secondarily transfers the toner image transferred onto the surface of the intermediate transfer member onto a surface of a recording medium; an apparatus including a cleaning unit that cleans the surface of the image holding member after transfer of the toner image and before charging; and an apparatus including an erasing unit that performs erasing by irradiating the surface of the image holding member with erasing light, after transfer of the toner image and before charging.

In the case where the image forming apparatus according to the exemplary embodiment is an intermediate transfer-type apparatus, a transfer unit has, for example, an intermediate transfer member having a surface onto which a toner image is to be transferred, a primary transfer unit that primarily transfers a toner image formed on a surface of an image holding member onto the surface of the intermediate transfer member, and a secondary transfer unit that secondarily transfers the toner image transferred onto the surface of the intermediate transfer member onto a surface of a recording medium.

In the image forming apparatus according to the exemplary embodiment, for example, a part including the developing unit may have a cartridge structure (process cartridge) that is detachable from the image forming apparatus. As the process cartridge, for example, a process cartridge provided with a developing unit that accommodates the electrostatic charge image developer according to the exemplary embodiment is preferably used.

Hereinafter, an example of the image forming apparatus according to the exemplary embodiment will be described. However, the image forming apparatus is not limited thereto. The major parts shown in the drawing will be described, but descriptions of other parts will be omitted.

FIG. 1 is a schematic configuration diagram showing the image forming apparatus according to the exemplary embodiment.

The image forming apparatus shown in FIG. 1 is provided with first to fourth electrophotographic image forming units 10Y, 10M, 10C, and 10K (image forming units) that output yellow (Y), magenta (M), cyan (C), and black (K) images based on color-separated image data, respectively. These image forming units (hereinafter, may be simply referred to as "units") 10Y, 10M, 10C, and 10K are arranged side by side at predetermined intervals in a horizontal direction. These units 10Y, 10M, 10C, and 10K may be process cartridges that are detachable from the image forming apparatus.

An intermediate transfer belt 20 as an intermediate transfer member is installed above the units 10Y, 10M, 10C, and 10K in the drawing to extend through the units. The intermediate transfer belt 20 is wound on a driving roll 22 and a support roll 24 contacting the inner surface of the intermediate transfer belt 20, which are disposed to be separated from each other on the left and right sides in the drawing, and travels in a direction toward the fourth unit 10K from the first unit 10Y. The support roll 24 is pressed in a direction in which it departs from the driving roll 22 by a spring or the like (not shown), and tension is given to the intermediate transfer belt 20 wound on both of the rolls. In addition, an intermediate transfer member cleaning device 30 opposed to the driving roll 22 is provided on a surface of the intermediate transfer belt 20 on the image holding member side.

Developing devices (developing units) 4Y, 4M, 4C, and 4K of the units 10Y, 10M, 10C, and 10K are supplied with toners including four colors of toner, that is, a yellow toner, a magenta toner, a cyan toner, and a black toner contained in toner cartridges 8Y, 8M, 8C, and 8K, respectively.

The first to fourth units 10Y, 10M, 10C, and 10K have the same configuration, and accordingly, only the first unit 10Y that is disposed on the upstream side in a traveling direction of the intermediate transfer belt to form a yellow image will be representatively described herein. The same parts as in the first unit 10Y will be denoted by the reference numerals with magenta (M), cyan (C), and black (K) added instead of yellow (Y), and descriptions of the second to fourth units 10M, 10C, and 10K will be omitted.

The first unit 10Y has a photoreceptor 1Y acting as an image holding member. Around the photoreceptor 1Y, a charging roll (an example of the charging unit) 2Y that charges a surface of the photoreceptor 1Y to a predetermined potential, an exposure device (an example of the electrostatic charge image forming unit) 3 that exposes the charged surface with laser beams 3Y based on a color-separated image signal to form an electrostatic charge image, a developing device (an example of the developing unit) 4Y that supplies charged toner to the electrostatic charge image to develop the electrostatic charge image, a primary transfer roll (an example of the primary transfer unit) 5Y that transfers the developed toner image onto the intermediate transfer belt 20, and a photoreceptor cleaning device (an example of the cleaning unit) 6Y that removes the toner remaining on the surface of the photoreceptor 1Y after primary transfer, are arranged in sequence.

The primary transfer roll 5Y is disposed inside the intermediate transfer belt 20 to be provided at a position opposed to the photoreceptor 1Y. Furthermore, bias supplies (not shown) that apply a primary transfer bias are connected to the primary transfer rolls 5Y, 5M, 5C, and 5K, respectively. Each bias supply changes a transfer bias that is applied to each primary transfer roll under the control of a controller (not shown).

Hereinafter, an operation of forming a yellow image in the first unit 10Y will be described.

First, before the operation, the surface of the photoreceptor 1Y is charged to a potential of −600 V to −800 V by the charging roll 2Y.

The photoreceptor 1Y is formed by laminating a photosensitive layer on a conductive substrate (for example, volume resistivity at 20° C.: $1\times10^{-6}$ Ωcm or less). The photosensitive layer typically has high resistance (that is about the same as the resistance of a general resin), but has properties in which when laser beams 3Y are applied, the specific resistance of a part irradiated with the laser beams changes. Accordingly, the laser beams 3Y are output to the charged surface of the photoreceptor 1Y via the exposure device 3 in accordance with image data for yellow sent from the controller (not shown). The laser beams 3Y are applied to the photosensitive layer on the surface of the photoreceptor 1Y, whereby an electrostatic charge image of a yellow image pattern is formed on the surface of the photoreceptor 1Y.

The electrostatic charge image is an image that is formed on the surface of the photoreceptor 1Y by charging, and is a so-called negative electrostatic charge image, that is formed by applying laser beams 3Y to the photosensitive layer so that the specific resistance of the irradiated part is lowered to cause charges to flow on the surface of the photoreceptor 1Y, while charges stay on a part to which the laser beams 3Y are not applied.

The electrostatic charge image formed on the photoreceptor 1Y is rotated up to a predetermined developing position with the travelling of the photoreceptor 1Y. The electrostatic charge image on the photoreceptor 1Y is visualized (developed) as a toner image at the developing position by the developing device 4Y.

The developing device 4Y accommodates, for example, an electrostatic charge image developer including at least a yellow toner and a carrier. The yellow toner is frictionally charged by being stirred in the developing device 4Y to have a charge with the same polarity (negative polarity) as the charge that is on the photoreceptor 1Y, and is thus held on the developer roll (an example of the developer holding member). By allowing the surface of the photoreceptor 1Y to pass through the developing device 4Y, the yellow toner electrostatically adheres to the electrostatic charge image part having been erased on the surface of the photoreceptor 1Y, whereby the electrostatic charge image is developed with the yellow toner. Next, the photoreceptor 1Y having the yellow toner image formed thereon continuously travels at a predetermined speed and the toner image developed on the photoreceptor 1Y is transported to a predetermined primary transfer position.

When the yellow toner image on the photoreceptor 1Y is transported to the primary transfer position, a primary transfer bias is applied to the primary transfer roll 5Y and an electrostatic force toward the primary transfer roll 5Y from the photoreceptor 1Y acts on the toner image, whereby the toner image on the photoreceptor 1Y is transferred onto the intermediate transfer belt 20. The transfer bias applied at this time has the opposite polarity (+) to the toner polarity (−), and, for example, is controlled to be +10 μA in the first unit 10Y by the controller (not shown).

Meanwhile, the toner remaining on the photoreceptor 1Y is removed and collected by the photoreceptor cleaning device 6Y.

The primary transfer biases that are applied to the primary transfer rolls 5M, 5C, and 5K of the second unit 10M and the subsequent units are also controlled in the same manner as in the case of the first unit.

In this manner, the intermediate transfer belt 20 onto which the yellow toner image is transferred in the first unit 10Y is sequentially transported through the second to fourth units 10M, 10C, and 10K, and the toner images of respective colors are multiply-transferred in a superimposed manner.

The intermediate transfer belt 20 onto which the four color toner images have been multiply-transferred through the first to fourth units reaches a secondary transfer part that is composed of the intermediate transfer belt 20, the support roll 24 contacting the inner surface of the intermediate transfer belt, and a secondary transfer roll (an example of the secondary transfer unit) 26 disposed on the image holding surface side of the intermediate transfer belt 20. Meanwhile, a recording sheet (an example of the recording medium) P is supplied to a gap between the secondary transfer roll 26 and the intermediate transfer belt 20, that are brought into contact with each other, via a supply mechanism at a predetermined timing, and a secondary transfer bias is applied to the support roll 24. The transfer bias applied at this time has the same polarity (−) as the toner polarity (−), and an electrostatic force toward the recording sheet P from the intermediate transfer belt 20 acts on the toner image, whereby the toner image on the intermediate transfer belt 20 is transferred onto the recording sheet P. In this case, the secondary transfer bias is determined depending on the resistance detected by a resistance detector (not shown) that detects the resistance of the secondary transfer part, and is voltage-controlled.

Thereafter, the recording sheet P is fed to a pressure-contacting part (nip part) between a pair of fixing rolls in a fixing device (an example of the fixing unit) 28 so that the toner image is fixed to the recording sheet P, whereby a fixed image is formed.

Examples of the recording sheet P onto which a toner image is transferred include plain paper that is used in electrophotographic copying machines, printers, and the like. As a recording medium, an OHP sheet is also exemplified other than the recording sheet P.

The surface of the recording sheet P is preferably smooth in order to further improve smoothness of the image surface after fixing. For example, coating paper obtained by coating a surface of plain paper with a resin or the like, art paper for printing, and the like are preferably used.

The recording sheet P on which the fixing of the color image is completed is discharged toward a discharge part, and a series of the color image forming operations ends.

Process Cartridge/Toner Cartridge

A process cartridge according to the exemplary embodiment will be described.

The process cartridge according to the exemplary embodiment is provided with a developing unit that accommodates the electrostatic charge image developer according to the exemplary embodiment and develops an electrostatic charge image formed on a surface of an image holding member with the electrostatic charge image developer to form a toner image, and is detachable from an image forming apparatus.

The process cartridge according to the exemplary embodiment is not limited to the above-described configuration, and may be configured to include a developing device, and if necessary, at least one selected from other units such as an image holding member, a charging unit, an electrostatic charge image forming unit, and a transfer unit.

Hereinafter, an example of the process cartridge according to the exemplary embodiment will be illustrated. However, the process cartridge is not limited thereto. Major parts shown in the drawing will be described, but descriptions of other parts will be omitted.

Figure 2:
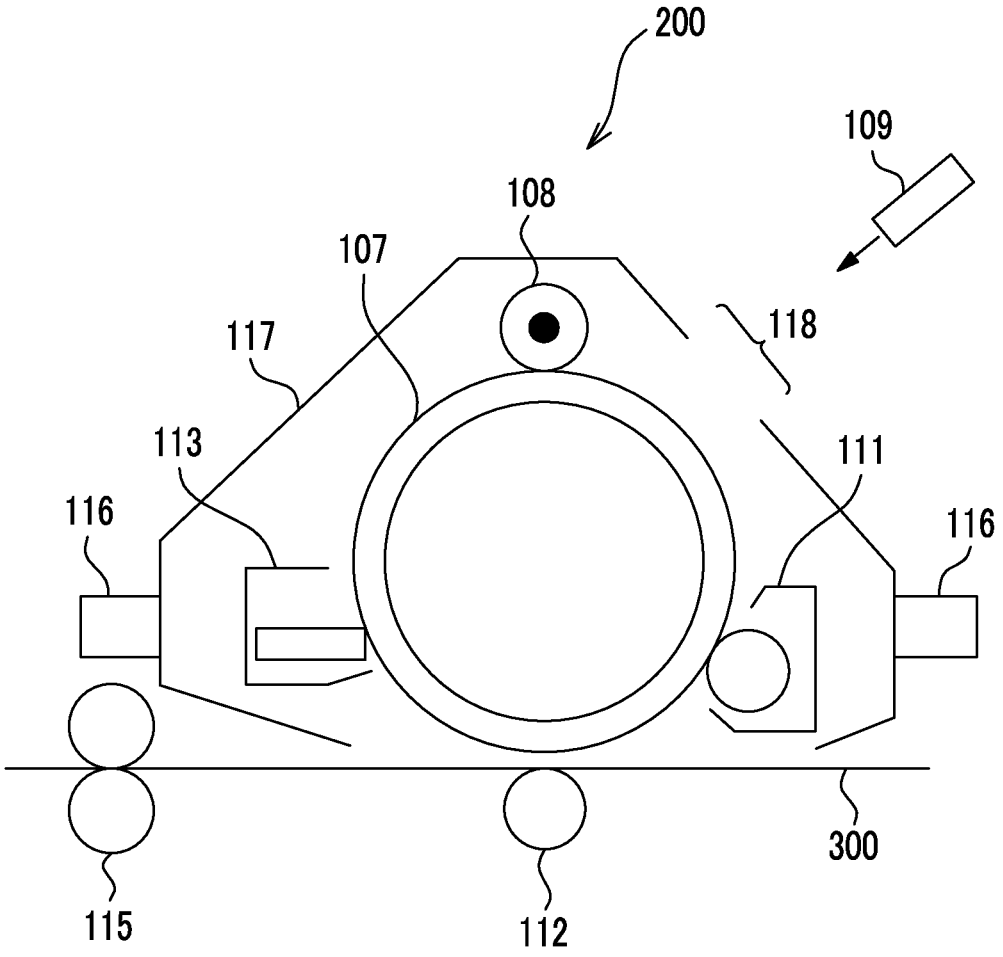
FIG. 2 is a schematic configuration diagram showing an example of a process cartridge according to the exemplary embodiment.

FIG. 2 is a schematic configuration diagram showing the process cartridge according to the exemplary embodiment.

A process cartridge 200 shown in FIG. 2 is formed as a cartridge having a configuration in which a photoreceptor 107 (an example of the image holding member), and a charging roll 108 (an example of the charging unit), a developing device 111 (an example of the developing unit), and a photoreceptor cleaning device 113 (an example of the cleaning unit), which are provided around the photoreceptor 107, are integrally combined and held by the use of, for example, a housing 117 provided with a mounting rail 116 and an opening 118 for exposure.

In FIG. 2, the reference numeral 109 represents an exposure device (an example of the electrostatic charge image forming unit), the reference numeral 112 represents a transfer device (an example of the transfer unit), the reference numeral 115 represents a fixing device (an example of the fixing unit), and the reference numeral 300 represents a recording sheet (an example of the recording medium).

Next, a toner cartridge according to the exemplary embodiment will be described.

The toner cartridge according to the exemplary embodiment accommodates the toner according to the exemplary embodiment and is detachable from an image forming apparatus. The toner cartridge accommodates a toner for replenishment to be supplied to the developing unit provided in the image forming apparatus.

The image forming apparatus shown in FIG. 1 has such a configuration that the toner cartridges 8Y, 8M, 8C, and 8K are detachable therefrom, and the developing devices 4Y, 4M, 4C, and 4K are connected to the toner cartridges corresponding to the respective developing devices (colors) via toner supply tubes (not shown), respectively. In addition, when the toner accommodated in the toner cartridge runs low, the toner cartridge is replaced.

EXAMPLES

Hereinafter, the exemplary embodiment will be more specifically described in detail using examples and comparative examples, but is not limited to these examples. In the following description, unless specifically noted, "parts" and "%" are based on weight.

Preparation of Polyester Resin Particle Dispersion

Preparation of Polyester Resin Particle Dispersion (1)

2.2 mol adduct of ethylene oxide of bisphenol A: 40 parts by mol 2.2 mol adduct of propylene oxide of bisphenol A: 60 parts by mol Dimethyl terephthalate: 60 parts by mol Dimethyl fumarate: 15 parts by mol Dodecenyl succinic acid anhydride: 20 parts by mol Trimellitic acid anhydride: 5 parts by mol The above monomers except for fumaric acid and trimellitic acid anhydride, and 0.25 parts of tin dioctanoate with respect to 100 parts of total monomers are added into a reaction vessel including a stirrer, a thermometer, a capacitor, and a nitrogen gas introducing tube. Under the nitrogen gas flow, the mixture is subjected to a reaction at 235° C. for 6 hours and is cooled to 200° C., and fumaric acid and trimellitic acid anhydride are added thereto and subjected to a reaction for 1 hour. The mixture is heated to 220° C. for 5 hours, and is polymerized under a pressure of 10 kPa until a desired molecular weight is obtained, and a transparent light yellow polyester resin (1) is obtained.

Regarding the polyester resin (1), a weight average molecular weight is 35,000, a number average molecular weight is 8,000, and a glass transition temperature is 59° C.

Next, the obtained polyester resin (1) is dispersed using a disperser which is obtained by modifying Cavitron CD1010 (manufactured by Eurotec Ltd.) into a high temperature and high pressure type. The pH is adjusted to 8.5 with ammonia at a composition concentration ratio of 80% of ion exchange water and 20% of the polyester resin, the Cavitron is operated under the conditions of a rotation rate of a rotator of 60 Hz, pressure of 5 $Kg/cm^2$, and heating at a temperature of 140° C. by a heat exchanger, and a polyester resin dispersion (solid content of 20%) is obtained.

A volume average particle diameter of the resin particles of this dispersion is 130 nm. Ion exchange water is added to the dispersion to adjust the solid content to 20%, and this is set as a polyester resin particle dispersion (1).

Preparation of Polyester Resin Particle Dispersion (2)

1,10-dodecanedioic acid: 50 parts by mol 1,9-nonanediol: 50 parts by mol

The above monomers are added into a reaction vessel including a stirrer, a thermometer, a capacitor, and a nitrogen gas introducing tube, the atmosphere in the reaction vessel is substituted with dry nitrogen gas, and then 0.25 parts of titanium tetrabutoxide is added to 100 parts of the above monomers. Under the nitrogen gas flow, the mixture is stirred, subjected to a reaction at 170° C. for 3 hours, and further heated to 210° C. for 1 hour, the pressure in the reaction vessel is reduced to 3 kPa, the mixture is stirred and subjected to a reaction under the reduced pressure for 13 hours, and a polyester resin (2) is obtained.

Regarding the polyester resin (2), a weight average molecular weight is 25,000, a number average molecular weight is 10,500, an acid value is 10.1 mgKOH/g, and a melting temperature obtained by DSC is 73.6° C.

Next, the obtained polyester resin (2) is dispersed using a disperser which is obtained by modifying Cavitron CD1010 (manufactured by Eurotec Ltd.) into a high temperature and high pressure type. The pH is adjusted to 8.5 with ammonia at a composition concentration ratio of 80% of ion exchange water and 20% of the polyester resin, the Cavitron is operated under the conditions of a rotation rate of a rotator of 60 Hz, pressure of 5 $Kg/cm^2$, and a temperature due to a heat exchanger of 140° C., and a polyester resin dispersion (solid content of 20%) is obtained.

A volume average particle diameter of the resin particles of this dispersion is 180 nm. Ion exchange water is added to the dispersion to adjust the solid content to 20%, and this is set as a polyester resin particle dispersion (2).

Preparation of Styrene (Meth)Acrylic Resin Particle Dispersion

Preparation of Styrene Acrylic Resin Particle Dispersion (1)

Styrene: 77 parts n-butyl acrylate: 23 parts 1,10-dodecandiol diacrylate: 0.4 parts Dodecanthiol: 0.7 parts A solution obtained by dissolving 1.0 part of an anionic surfactant (DOWFAX manufactured by The Dow Chemical Company) in 60 parts of ion exchange water is added to a mixture obtained by mixing and dissolving the above materials, and the mixture is dispersed and emulsified in a flask, and an emulsified solution is prepared.

Then, 3 parts of the anionic surfactant (DOWFAX manufactured by The Dow Chemical Company) is dissolved in 90 parts of ion exchange water, 30 parts of the emulsified solution is added thereto, and 10 parts of ion exchange water in which 1.0 part of ammonium persulfate is dissolved is added thereto.

After that, the remaining emulsified solution is added for 3 hours, nitrogen substitution in the flask is performed, the mixture is heated in oil bath to 65° C. while stirring the solution in the flask, emulsification and polymerization is continued in this state for 5 hours, and a styrene acrylic resin particle dispersion (1) is obtained. If necessary, ion exchange water is added to the styrene acrylic resin particle dispersion (1), and the solid content is adjusted to 32%.

Preparation of Styrene Acrylic Resin Particle Dispersion (2)

A styrene acrylic resin particle dispersion (2) having solid content of 32% is obtained in the same manner as in the case of the styrene acrylic resin particle dispersion (1), except for changing the amount of the emulsified solution to be added from 30 parts to 40 parts and the amount of the anionic surfactant in the solution to which the emulsified solution is added from 3 parts to 4 parts.

Preparation of Styrene Acrylic Resin Particle Dispersion (3)

A styrene acrylic resin particle dispersion (3) having solid content of 32% is obtained in the same manner as in the case of the styrene acrylic resin particle dispersion (1), except for changing the amount of the emulsified solution to be added from 30 parts to 50 parts and the amount of the anionic surfactant in the solution to which the emulsified solution is added from 3 parts to 5 parts.

Preparation of Styrene Acrylic Resin Particle Dispersion (4)

A styrene acrylic resin particle dispersion (4) having solid content of 32% is obtained in the same manner as in the case of the styrene acrylic resin particle dispersion (1), except for changing the amount of the emulsified solution to be added from 30 parts to 20 parts and the amount of the anionic surfactant in the solution to which the emulsified solution is added from 3 parts to 2 parts.

Herein, a volume average particle diameter, a number average molecular weight Mn, and a weight average molecular weight Mw of particles of each styrene acrylic resin particle dispersion are shown in Table 1 as a list.

Preparation of Colorant Particle Dispersion

Preparation of Black Pigment Dispersion (1)

Carbon black (Regal 330 manufactured by Cabot Corporation): 250 parts

Anionic surfactant (NEOGEN SC manufactured by Dai-Ichi Kogyo Seiyaku Co., Ltd.): 33 parts (active ingredient amount: 60%, 8% with respect to the colorant)

Ion exchange water: 750 parts 280 parts of ion exchange water and 33 parts of the anionic surfactant are added to a stainless steel vessel having a size that a height of a solution surface is approximately ⅓ of a height of the vessel when all of the above components are added thereto, the surfactant is sufficiently dissolved, all of the solid solution pigments are added thereto, stirred using a stirrer until there is no unwet pigments, and sufficiently subjected to defoaming. After defoaming, remaining ion exchange water is added and the obtained mixture is dispersed using a homogenizer (Ultra Turrax T50 manufactured by IKA Japan, K.K.) at 5,000 rotations for 10 minutes, and the mixture is stirred using a stirrer for 24 hours and subjected to defoaming. After defoaming, the mixture is dispersed again using a homogenizer at 6,000 rotations for 10 minutes, and mixture is stirred using a stirrer for 24 hours and subjected to defoaming. Then, the dispersion is dispersed at the pressure of 240 MPa using a high-pressure impact type disperser ULTIMIZER (HJP30006 manufactured by SUGINO MACHINE LIMITED). The dispersion is performed to be equivalent to 25 passes by conversion from total added amount and capacity of the apparatus. The obtained dispersion is kept for 72 hours to remove a precipitate, ion exchange water is added thereto to adjust the solid content concentration to 15%, and a colorant particle dispersion (1) is obtained. A volume average particle diameter D50 of particles in the colorant particle dispersion (1) is 135 nm.

Preparation of Release Agent Dispersion

Preparation of Release Agent Dispersion (1)

Polyethylene wax (hydrocarbon wax: product name "POLYWAX 725 (manufactured by Baker Petrolite Corporation)", melting temperature of 104° C.): 270 parts Anionic surfactant (NEOGEN RK manufactured by Dai-Ichi Kogyo Seiyaku Co., Ltd., active ingredient amount: 60%): 13.5 parts (3.0% with respect to release agent as the active ingredient)

Ion exchange water: 21.6 parts

The above components are mixed with each other, the release agent is dissolved at an inner solution temperature of 120° C. using a pressure discharge type homogenizer (Gaulin homogenizer manufactured by Gaulin Co., Ltd.), the mixture is dispersed at dispersion pressure of 5 MPa for 120 minutes and then at pressure of 40 MPa for 360 minutes, and cooled, and a release agent dispersion (1) is obtained. A volume average particle diameter D50 of particles in the release agent dispersion (1) is 225 nm. Then, ion exchange water is added to adjust the solid content concentration to be 20.0%.

Preparation of Release Agent Dispersion (2)

A release agent dispersion (2) is obtained in the same manner as in the case of the release agent dispersion (1), except for using paraffin wax (hydrocarbon wax: product name: "HNP0190 (manufactured by Nippon Seiro Co., Ltd.)", melting temperature of 85° C.) instead of the polyethylene wax.

Preparation of Release Agent Dispersion (3)

A release agent dispersion (3) is obtained in the same manner as in the case of the release agent dispersion (1), except for using paraffin wax (hydrocarbon wax: product name: "HNP9 (manufactured by Nippon Seiro Co., Ltd.)", melting temperature of 75° C.) instead of the polyethylene wax.

Preparation of Release Agent Dispersion (4)

A release agent dispersion (4) is obtained in the same manner as in the case of the release agent dispersion (1), except for using polyethylene wax (hydrocarbon wax: product name: "POLYWAX 1000 (manufactured by Baker Petrolite Corporation)", melting temperature of 113° C.) as the polyethylene wax.

Preparation of Release Agent Dispersion (5)

A release agent dispersion (5) is obtained in the same manner as in the case of the release agent dispersion (1), except for using synthetic wax copolymer of α-olefin and maleic anhydride (synthetic wax: product name "DIACARNA (manufactured by Mitsubishi Chemical Co., Ltd.)", melting temperature of 74° C.) instead of the polyethylene wax.

Preparation of Mixed Particle Dispersion

Preparation of Mixed Particle Dispersion (1)

400 parts of the polyester resin particle dispersion (1), 60 parts of the release agent dispersion (1), and 2.9 parts of the anionic surfactant (Dowfax 2A1 manufactured by The Dow Chemical Company) are mixed with each other, 1.0% nitric acid is added thereto at a temperature of 25° C., pH is adjusted to 3.0, and a mixed particle dispersion (1) is obtained.

Preparation of Mixed Particle Dispersions (2) to (5)

Mixed particle dispersions (2) to (5) are obtained in the same manner as in the case of the mixed particle dispersion (1), except for using respective release agent dispersions (2) to (5) instead of the release agent dispersion (1).

Example 1

Preparation of Toner Particle (1)

Polyester resin particle dispersion (1): 700 parts
Polyester resin particle dispersion (2): 50 parts
Styrene acrylic resin particle dispersion (1): 205 parts
Black pigment dispersion (1): 133 parts
Release agent dispersion (1): 15 parts
Ion exchange water: 600 parts
Anionic surfactant (Dowfax 2A1 manufactured by The Dow Chemical Company): 2.9 parts After adding the above materials in a 3-liter reaction vessel including a thermometer, a pH meter, and a stirrer and adding 1.0% nitric acid at 25° C. to adjust pH to 3.0, and 100 parts of an aluminum sulfate aqueous solution having concentration of 2% is added thereto while dispersing the mixture using a homogenizer (Ultra Turrax T50 manufactured by IKA Japan, K.K.) at 3,000 rpm.

Since viscosity of the raw material dispersion rapidly increases during dropwise addition of the aggregating agent, the dropwise addition speed is decreased when the viscosity starts to increase, to make the aggregating agent not to be biased to one portion. When the dropwise addition of the aggregating agent is completed, the mixture is further stirred for 5 minutes after increasing the rotation rate to 5,000 rpm.

After that, a stirrer and a mantle heater are installed in the reaction vessel, the temperature is raised at a rate of temperature rise of 0.2° C./min up to 40° C. and at a rate of temperature rise of 0.05° C./min up to 53° C. when the temperature is higher than 40° C., while adjusting the rotation rate of the stirrer so that the slurry is sufficiently stirred, and the particle diameters are measured using Multisizer II (aperture diameter of 50 μm, manufactured by Beckman Coulter K.K) for every 10 minutes. The temperature is kept when a volume average particle diameter becomes 5.0 μm, and 460 parts of the mixed particle dispersion (1) is added thereto for 5 minutes.

In order to stop growth of the aggregated particles forming the coating layer, after keeping the mixture at 50° C. for 30 minutes, 8 parts of 20% solution of ethylenediaminetetraacetic acid (EDTA) is added to the reaction vessel, 1 mol/liter of a sodium hydroxide aqueous solution is added thereto, and pH of the raw material dispersion is controlled to 9.0. After that, the temperature is increased to 90° C. at a temperature increasing rate of 1° C./min while adjusting pH to 9.0 for every 5° C., and the mixture is kept at 90° C. When a particle shape and a surface property are observed with an optical microscope and a field-emission scanning electron microscope (FE-SEM), coalescence of the particles is checked when 6 hours has elapsed, and accordingly the vessel is cooled to 30° C. with cooling water for 5 minutes.

The cooled slurry is caused to pass through nylon mesh having an aperture of 15 μm to remove coarse powder, and the toner slurry passed the mesh is filtrated with an aspirator under the reduced pressure. The solid remaining on the filter paper is pulverized with a hand as small as possible, added to ion exchange water the amount of which is 10 times of the amount of the solid at 30° C., and stirred and mixed for 30 minutes. Then, the mixture is filtrated with an aspirator under the reduced pressure, the solid remaining on the filter paper is pulverized with a hand as small as possible, added to ion exchange water the amount of which is 10 times of the amount of the solid at 30° C., stirred and mixed for 30 minutes, and filtrated with an aspirator under the reduced pressure, again, and electrical conductivity of the filtrate is measured. This operation is repeated until the electrical conductivity of the filtrate becomes 10 μS/cm or less and the solid is washed.

The washed solid is finely pulverized with a wet type and dry-type granulator (Comil), is subjected to vacuum drying in an oven at 35° C. for 36 hours, and toner particles (1) are obtained. A volume average particle diameter of the obtained toner particles (1) is 6.0 μm.

Preparation of Silica Particles

A stirrer, a dripping funnel, and a thermometer are set in a glass reaction vessel, 15 parts of ethanol and 28 parts of tetraethoxysilane are added thereto and stirred at a rotation rate of 100 rpm while keeping the temperature to 35° C. Then, 30 parts of an ammonia aqueous solution having concentration of 20% is added dropwise for 5 minutes while continuing the stirring. After performing the reaction for 1 hour in this state, a supernatant is removed by centrifugation. In addition, 100 parts of toluene is added to create a suspension, hexamethyldisilazane, the amount of which is 60% by weight with respect to the solid content in the suspension is added thereto and subjected to reaction at 95° C. for 4 hours. After that, the suspension is heated, toluene is removed, the drying is performed, coarse powder is removed with a sieve having an aperture of 106 μm, and silica particles having a number average particle diameter of 120 nm are obtained.

Preparation of Carrier (1)

After adding 500 parts of spherical magnetite particle powder having a volume average particle diameter of 0.18 μm into a Henschel mixer and sufficiently stirring, 5.0 parts of a titanate coupling agent is added thereto, heated to 95° C. and mixed and stirred for 30 minutes, and spherical magnetite particles coated with the titanate coupling agent are obtained.

Then, 6.0 parts of phenol, 10 parts of 30% formalin, 500 parts of the magnetite particles, 7 parts of 25% ammonia water, and 400 parts of water are mixed and stirred in a 1-liter four-necked flask. After heating the mixture to 90° C. for 60 minutes while stirring and causing the mixture to be subjected to the reaction at the same temperature for 180 minutes, the mixture is cooled to 30° C., 500 ml of water is added thereto, a supernatant is removed, and a precipitate is washed. This is dried at 180° C. under the reduced pressure, coarse powder is removed with a sieve having an aperture of 106 μm, and core particles having an average particle diameter of 38 μm are obtained.

Then, 200 parts of toluene and 35 parts of styrene-methyl methacrylate copolymer (component mol ratio of 10:90 and weight average molecular weight of 160,000) are stirred with a stirrer for 90 minutes, and a coating resin solution is obtained.

1,000 parts of the core particles and 70 parts of the coating resin solution are added into a vacuum deairing type kneader coater (clearance between a rotor and a wall surface of 35 mm), stirred at 30 rpm at 65° C. for 30 minutes, and further heated to 88° C., and toluene removing, deairing, and drying are performed under the reduced pressure. By sieving with mesh having an aperture of 75 μm, a carrier (1) is prepared. A shape factor SF2 of the carrier is 104.

Preparation of Developer (1)

After blending 100 parts of the toner particles (1) and 1.5 parts of the silica particles using a Henschel mixer at a circumferential speed of 20 m/s for 15 minutes, coarse particles are removed using a sieve having an aperture of 45 μm, and a toner (1) is obtained.

8 parts of the obtained toner (1) and 100 parts of the carrier (1) are stirred using a V-blender at 20 rpm for 20 minutes and sieved with a sieve having an aperture of 212 μm, and accordingly, a developer (1) is obtained.

Examples 2 to 9

Toner particles (2) to (9) are obtained in the same manner as in the case of toner particles (1) of Example 1, except for changing the types and number of parts (amount) of the polyester resin particle dispersion (noted as "PE dispersion" in Table), the styrene acrylic resin particle dispersion (noted as "StAc dispersion" in Table), the release agent dispersion, and the mixed particle dispersion (noted as "mixed dispersion" in Table) according to Table 2. Developers (2) to (9) are obtained in the same manner as in the case of the developer (1) of Example 1, using the toner particles (2) to (9).

Comparative Examples 1 to 4

Toner particles (C1) to (C4) are obtained in the same manner as in the case of toner particles (1) of Example 1, except for changing the types and number of parts (amount) of the polyester resin particle dispersion (noted as "PE dispersion" in Table), the styrene acrylic resin particle dispersion (noted as "StAc dispersion" in Table), the release agent dispersion, and the mixed particle dispersion (noted as "mixed dispersion" in Table) according to Table 2. Developers (C1) to (C4) are obtained in the same manner as in the case of the developer (1) of Example 1, using the toner particles (C1) to (C4).

Measurement

Regarding the toner particles obtained in each example, the "presence ratio of the release agent" is measured by the above-described method. In addition, regarding the styrene acrylic resin (noted as "StAc resin" in Table), the "average diameter of the domain", the "number ratio of the domains having diameter in a range of the average diameter ±0.1 μM (noted as "number ratio of domains with average diameter ±0.1 μm" in Table)", and the "number ratio of the domains having diameter in a range of the average diameter ±0.2 μm (noted as "number ratio of domains with average diameter ±0.2 μm" in Table)" are measured by the above-described method. Results are shown in Table 2.

Evaluation

Evaluation of Cracks of Toner Particle

A developing device of remodeled Apeos Port II C4300 manufactured by Fuji Xerox Co., Ltd. (remodeled device which is remodeled so as to stop toner supply to the developing device and to output an image even when there is no developing device for other color which is not used in the evaluation) is filled with the developer obtained in each example.

10,000 A3-sized sheets having no image are output using this remodeled device, and the developer in the developing device is set to be continuously stirred while performing the output.

The GSDp of the toner (toner particles) separated from the developer which is just prepared (set as GSDp1) and the GSDp of the toner (toner particles) separated from the developer in the developing device after outputting 10,000 sheets (set as GSDp2) are measured, "GSDp2/GSDp1" is determined, and cracks on toner are evaluated.

The separation of the toner from the developer is performed by adding the developer into 5% weight aqueous solution of sodium alkyl benzene sulfonate and separating the carrier using magnet.

Determination criteria of the evaluation of the cracks on the toner particle are as follows. 1.18 or smaller "GSDp2/GSDp1" is regarded as acceptable, and "GSDp2/GSDp1" close to 1.00 is preferable.

A: "GSDp2/GSDp1"≤1.10

B: 1.10<"GSDp2/GSDp1"≤1.15

C: 1.15<"GSDp2/GSDp1"≤1.18

D: 1.18<"GSDp2/GSDp1"

TABLE 1

| StAc dispersion | Volume average particle diameter (μm) | Number average molecular weight Mn | Weight average molecular weight Mw |
|---|---|---|---|
| (1) | 62 | 23000 | 61000 |
| (2) | 50 | 19000 | 51000 |
| (3) | 39 | 12000 | 39000 |
| (4) | 102 | 25000 | 97000 |

TABLE 2

| | PE dispersion Type/number | StAc dispersion Type/number | Release agent dispersion Type/number | Mixed dispersion Type/number | Release agent Type | Release agent Presence ratio of release agent [%] | StAc resin Average diameter of domains [μm] | StAc resin Number ratio of domains with average diameter ± 0.1 μm [%] | StAc resin Number ratio of domains with average diameter ± 0.2 μm [%] | Evaluation of toner cracks GSDp2/GSDp1 | Evaluation of toner cracks Evaluation |
|---|---|---|---|---|---|---|---|---|---|---|---|
| Ex. 1 | (1)/700 (2)/50 | (1)/205 | (1)/15 | (1)/460 | Hydrocarbon-based | 70 | 0.29 | 75 | 90 | 1.14 | B |
| Ex. 2 | (1)/700 (2)/50 | (2)/205 | (1)/15 | (1)/460 | Hydrocarbon-based | 70 | 0.20 | 75 | 90 | 1.08 | A |
| Ex. 3 | (1)/700 (2)/50 | (3)/205 | (1)/15 | (1)/460 | Hydrocarbon-based | 70 | 0.10 | 65 | 80 | 1.17 | C |
| Ex. 4 | (1)/700 (2)/50 | (2)/140 (4)/65 | (1)/15 | (1)/460 | Hydrocarbon-based | 70 | 0.255 | 71 | 85 | 1.14 | B |
| Ex. 5 | (1)/700 (2)/50 | (2)/105 (4)/100 | (1)/15 | (1)/460 | Hydrocarbon-based | 70 | 0.295 | 65 | 81 | 1.16 | C |
| Ex. 6 | (1)/700 (2)/50 | (1)/205 | (1)/15 | (2)/460 | Hydrocarbon-based | 70 | 0.29 | 75 | 90 | 1.14 | B |
| Ex. 7 | (1)/700 (2)/50 | (1)/205 | (1)/15 | (3)/460 | Hydrocarbon-based | 70 | 0.29 | 75 | 90 | 1.14 | B |
| Ex. 6 | (1)/700 (2)/50 | (1)/205 | (1)/15 | (4)/460 | Hydrocarbon-based | 70 | 0.29 | 75 | 90 | 1.14 | B |
| Ex. 7 | (1)/700 (2)/50 | (1)/205 | (2)/15 | (1)/460 | Hydrocarbon-based | 70 | 0.29 | 72 | 85 | 1.14 | B |
| Ex. 8 | (1)/700 (2)/50 | (1)/205 | (3)/15 | (1)/460 | Hydrocarbon-based | 70 | 0.29 | 73 | 86 | 1.14 | B |
| Ex. 9 | (1)/700 (2)/50 | (1)/205 | (4)/15 | (1)/460 | Hydrocarbon-based | 70 | 0.28 | 74 | 88 | 1.14 | B |
| Com. Ex. 1 | (1)/700 (2)/50 | (1)/205 | (1)/15 | (1)/460 | Hydrocarbon-based | 68 | 0.297 | 65 | 80 | 1.19 | D |
| Com. Ex. 2 | (1)/700 (2)/50 | (4)/205 | (1)/15 | (1)/460 | Hydrocarbon-based | 70 | 0.403 | 70 | 85 | 1.21 | D |
| Com. Ex. 3 | (1)/700 (2)/50 | (2)/25 (4)/180 | (1)/15 | (1)/460 | Hydrocarbon-based | 70 | 0.310 | 65 | 80 | 1.20 | D |
| Com. Ex. 4 | (1)/700 (2)/50 | (1)/205 | (5)/15 | (5)/460 | Ester-based | 70 | 0.29 | 75 | 90 | 1.20 | D |

From the above results, it is found that generation of cracks on the toner particle is prevented in Examples, compared to Comparative Examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner comprising:

a toner particle having a core/shell structure, the core comprising (i) a binder resin containing a polyester resin and (ii) a styrene (meth)acrylic resin, and the shell comprising a release agent containing hydrocarbon wax, wherein:

70% or more of the release agent of the entire release agent is present in a portion within 800 nm from the surface of the toner particle; and the styrene (meth)acrylic resin forms a domain having an average diameter of smaller than 0.3 μm in the toner particle.

2. The electrostatic charge image developing toner according to claim 1, wherein a number ratio of the domains having a diameter in a range of the average diameter ±0.1 μm is equal to or greater than 65% in the toner particle.

3. The electrostatic charge image developing toner according to claim 1, wherein a number ratio of the domains having a diameter in a range of the average diameter ±0.2 μm is equal to or greater than 80% in the toner particle.

4. The electrostatic charge image developing toner according to claim 1, wherein a glass transition temperature (Tg) of the polyester resin is from 50° C. to 80° C.

5. The electrostatic charge image developing toner according to claim 1, wherein a weight average molecular weight (Mw) of the polyester resin is from 5,000 to 1,000,000.

6. The electrostatic charge image developing toner according to claim 1, wherein a number average molecular weight (Mn) of the polyester resin is from 2,000 to 100,000.

7. The electrostatic charge image developing toner according to claim 1, wherein a molecular weight distribution Mw/Mn of the polyester resin is from 1.5 to 100.

8. The electrostatic charge image developing toner according to claim 1, wherein the styrene (meth)acrylic resin is a copolymer obtained by a monomer having a styrene structure and a monomer having a (meth)acrylic acid structure, and a copolymerization ratio of the monomer having a styrene structure and the monomer having a (meth) acrylic acid structure is from 85/15 to 70/30.

9. The electrostatic charge image developing toner according to claim 1, wherein a number average molecular weight Mn of the styrene (meth)acrylic resin is from 10,000 to 50,000.

10. The electrostatic charge image developing toner according to claim 1, wherein a weight average molecular weight Mw of the styrene (meth)acrylic resin is from 30,000 to 200,000.

11. The electrostatic charge image developing toner according to claim 1, wherein the styrene (meth)acrylic resin has a crosslinked structure.

12. The electrostatic charge image developing toner according to claim 11, wherein a copolymerization ratio of a crosslinking monomer with respect to the entirety of monomers constituting the styrene (meth)acrylic resin (crosslinking monomer/entirety of monomer based on weight) is from 2/1000 to 30/1000.

13. The electrostatic charge image developing toner according to claim 1, wherein a content of the styrene (meth)acrylic resin is from 10% by weight to 30% by weight with respect to the toner particle.

14. The electrostatic charge image developing toner according to claim 1, wherein a rate of the hydrocarbon wax with respect to the entire release agent is equal to or greater than 85% by weight.

15. The electrostatic charge image developing toner according to claim 1, wherein a melting temperature of the hydrocarbon wax is from 85° C. to 110° C.

16. The electrostatic charge image developing toner according to claim 1, wherein a content of the hydrocarbon wax is from 1% by weight to 20% by weight with respect to the entirety of the toner particles.

17. An electrostatic charge image developer comprising the electrostatic charge image developing toner according to claim 1.

18. The electrostatic charge image developer according to claim 17, further comprising:

a magnetic particle dispersion-type carrier.

19. A toner cartridge that accommodates the electrostatic charge image developing toner according to claim 1, and is detachable from an image forming apparatus.

* * * * *